United States Patent [19]

Emery

[11] 4,418,751

[45] Dec. 6, 1983

[54] IN-SITU COMBUSTION PROCESS

[75] Inventor: Leonard W. Emery, Plano, Tex.

[73] Assignee: Atlantic Richfield Company, Los Angeles, Calif.

[21] Appl. No.: 364,116

[22] Filed: Mar. 31, 1982

[51] Int. Cl.[3] ..... E21B 43/243

[52] U.S. Cl. ..... 166/261; 166/52

[58] Field of Search ..... 166/261, 256, 258, 57, 166/52

[56] References Cited

U.S. PATENT DOCUMENTS

| | | | |
|---|---|---|---|
| 2,994,375 | 8/1961 | Hurley | 166/261 X |
| 3,159,215 | 12/1964 | Meldau | 166/258 |
| 3,167,121 | 1/1965 | Sharp | 166/261 X |
| 3,208,519 | 9/1965 | Moore | 166/261 |
| 3,554,285 | 1/1971 | Meldau | 166/258 |
| 3,565,174 | 2/1971 | Parker | 166/269 X |
| 3,978,920 | 9/1976 | Bandyopadhyay et al. | 166/258 |
| 4,042,026 | 8/1977 | Pusch et al. | 166/261 X |
| 4,252,191 | 2/1981 | Pusch et al. | 166/261 |

*Primary Examiner*—Stephen J. Novosad

*Attorney, Agent, or Firm*—Roderick W. MacDonald

[57] ABSTRACT

A method for conducting an in situ combustion process in a hydrocarbon-bearing subsurface geologic formation wherein water and essentially pure oxygen are injected into a well at essentially the same time but physically separated from one another so that a combined hot water/steam and in situ combustion drive is set up in the formation for the tertiary recovery of hydrocarbons therefrom.

6 Claims, 1 Drawing Figure

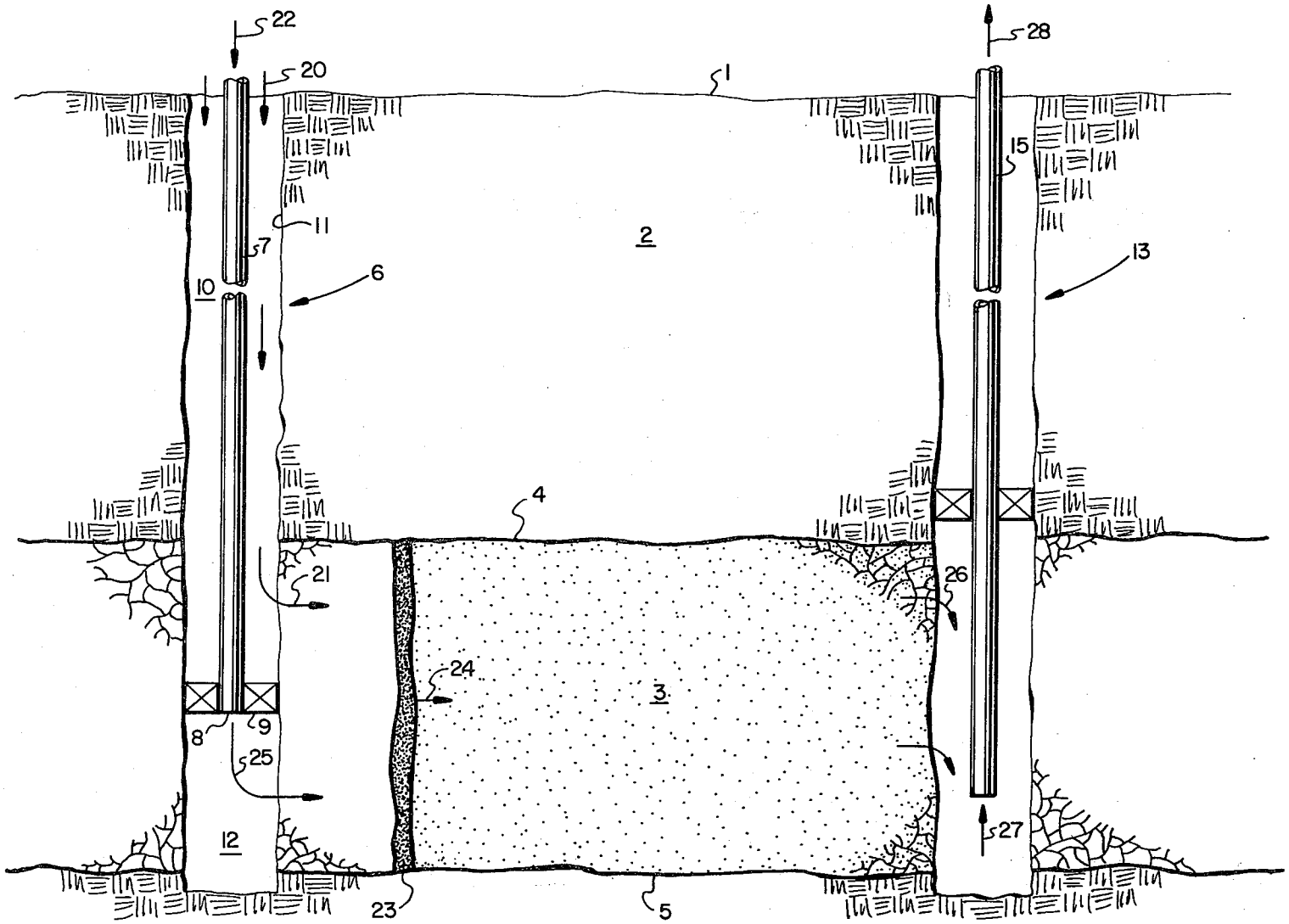
28
22
20
13
15
1
2
6
11
7
10
4
3
21
9
8
25
12
24
26
27
5
23

IN-SITU COMBUSTION PROCESS

BACKGROUND OF THE INVENTION

Heretofore, numerous procedures have been proposed, and some tested, for the tertiary recovery of hydrocarbons such as crude oil from subsurface geologic formations or reservoirs to maximize the recovery of oil from those reservoirs. In this regard, numerous materials have been injected into reservoirs, for example, hot water, steam, miscible displacement fluids, micellar displacement fluids, and the like.

Also heretofore, in situ combustion procedures have been proposed and tested wherein a fire was lit in the reservoir itself utilizing oil in place as fuel, and an oxidant such as air was injected into the reservoir to keep the fire going. This procedure heats the reservoir and the oil remaining therein to render the oil more flowable and thereby maximize the quantity of oil recovered from a given reservoir.

BRIEF SUMMARY OF THE INVENTION

According to this invention there is provided a method for conducting an in situ production process in one or more hydrocarbon-bearing subsurface geologic formations or reservoirs wherein there is provided at least one wellbore which has a tubing string in the interior thereof. The tubing string extends for a portion of the length of the wellbore and terminates in the wellbore in the region of the reservoir in which the in situ combustion process is to be carried out. The wellbore also has an annulus between the exterior of the tubing and the interior of the wellbore, and a packoff therein which separates the portion of the wellbore below the end of the tubing from the annulus. In accordance with the process of this invention water is then injected into the annulus and from there into an upper portion of the reservoir, while at essentially the same time as the water injection, essentially pure oxygen is injected into said tubing and from there passes into a lower portion of the reservoir to provide the oxidant for an in situ combustion process.

Accordingly, it is an object of this invention to provide a new and improved in situ combustion process for the recovery of hydrocarbons from underground hydrocarbon-bearing reservoirs. It is another object to provide a new and improved tertiary recovery process for hydrocarbons. Other aspects, objects and advantages of this invention will be apparent to those skilled in the art from this disclosure and the appended claims.

BRIEF DESCRIPTION OF THE DRAWING

The drawing shows a cross section of two wellbores extending from the earth's surface into the earth, one of which wellbores is operated in accordance with the method of this invention to set up a combustion front in a reservoir, the other wellbore being a production wellbore into which oil is forced by way of the in situ combustion front.

DETAILED DESCRIPTION OF THE INVENTION

More specifically, the drawings show the earth's surface 1 below which is overburden 2 and under which is hydrocarbon-bearing reservoir 3 as delineated by upper reservoir rock limit 4 and lower limit 5. It should be noted here that although this invention is described with respect to the recovery of conventional crude oil, it is also applicable to other hydrocarbon sources such as heavy oil, tar, bitumin, and the like, so long as the reservoir which contains these hydrocarbons is amenable to an in situ combustion procedure.

Two wellbores 6 and 13 have been drilled into the earth and into reservoir 3.

Wellbore 6 has a string of tubing 7 therein whose lower end 8 is fixed in place in the wellbore by way of conventional packoff 9. Annulus 10 in wellbore 6 which extends between the exterior wall of tubing 7 and interior wall 11 of wellbore 6 (or any casing therein) is thus physically separated by packoff 9 from lower portion 12 of wellbore 6. Thus, zone 12 of wellbore 6 is in communication with the earth's surface only through tubing 7 and there is no fluid communication between annulus 10 and zone 12.

Wellbore 13 has a string of production tubing 15 supported therein by conventional means (not shown) for the recovery to the earth's surface of oil which flows from reservoir 3 into wellbore 13.

In the process of this invention, water, be it fresh water, salt water, or the like, is injected into annulus 10 as shown by arrow 20 to flow down annulus 10 and then into reservoir 3 as shown by arrow 21. At essentially the same time, essentially pure oxygen is injected into tubing 7 as shown by arrow 22 to flow down the interior of tubing 7 into zone 12 and from there into reservoir 3 as shown by arrow 25.

A fire is ignited in reservoir 3 in the vicinity of zone 12 in a conventional manner known in the art and the oxygen supplied by way of tubing 7 keeps the fire going as it progresses further out into the reservoir 3.

Thus, by the process of this invention there is established in reservoir 3 a hot water/steam flood combined with an in situ combustion drive. The narrow band or front in reservoir 3 in which the active combustion of hydrocarbons takes place, along with the heating of water and the formation of steam, is shown at 23. It should be noted that front 23 continuously moves away from wellbore 6 toward wellbore 13 as shown by arrow 24, thereby driving more and more oil from reservoir 3 into wellbore 13 for recovery to the earth's surface by way of tubing 15.

There are numerous advantages for the process of this invention which will be readily apparent to those skilled in the art. Some of these advantages are set forth hereinafter, although these are by no means all the advantages for this invention.

First of all, there is a considerable safety advantage in that tubing 7 which is conducting a large volume of highly flammable oxidant is surrounded by a water-filled annulus 10.

Further, by utilizing water injection, along with an in situ combustion drive, no hot water or even heated reservoir rock is left behind front 23 because the injected water continually picks up heat from the reservoir rock and pushes the hot water forward with front 23. Thus, substantial energy conservation is realized.

There is considerable mixing in band 23 between water (due to gravity forces) and the in situ combustion drive (due to the tendency of hot gases to rise), so that there is substantial mixing, heating, and formation of steam which is driven along not only by the in situ combustion drive but also by the simultaneous water drive.

By using essentially pure oxygen, and by essentially pure is meant at least 90 volume percent elemental oxygen preferably with no or substantially no nitrogen present, a more efficient in situ drive procedure is established. For example, if air were injected instead of essentially pure oxygen, a substantial amount of nitrogen would be injected into reservoir 3. The nitrogen takes up a substantial amount of the limited pore space already available in the reservoir rock, does not readily go into solution into the water present, is not combustible, and, by its presence, reduces the partial pressure of the carbon dioxide that is present. All of these provide no aid in the recovery of oil from reservoir 3 and even combine together to effectively slow down the progress of zone 23 in the reservoir. Thus, the presence of nitrogen is really a detriment to the process. By eliminating all, or essentially all of the nitrogen from the oxidant, the limited pore space available in the reservoir rock is filled with gases such as $CO_2$ at a higher partial pressure and which are useful in the tertiary recovery of oil. For example, $CO_2$ will dissolve in the water and, if conditions are right, can help provide a miscible displacement drive of oil from reservoir rock in addition to the steam, water and in situ combustion drives already present. Even if miscible displacement is not established, the swelling of water caused by the carbon dioxide going into solution in the water still beneficially aid the water drive and, therefore, the displacement of oil from reservoir 3.

Accordingly, there are numerous substantial benefits from the particular combination of process steps employed by this invention.

When this invention is employed in reservoir 3, zone 23 is established and starts moving towards wellbore 13. Additional oil is thereby displaced from reservoir 3 and forced therefrom into wellbore 13 as shown by arrows 26. The oil then passes into tubing 15 as shown by arrow 27 and recovered at the earth's surface as shown by arrow 28 for pipelining to a refinery and further processing into useful hydrocarbon-based products.

The amount of water and essentially pure oxygen injected into a reservoir or reservoirs pursuant to this invention can vary widely in composition and in the amount injected, depending upon the particular characteristics of the reservoir and the like. These parameters are not critical to the operability of the invention, and can readily be established by one skilled in the art once the characteristics of the particular reservoir are known. So further detail is not necessary here to inform the art. However, it is preferred that the water be injected at a rate of at least 3 gallons per minute and the oxygen be injected at a rate of at least 20 cubic feet per minute. The continued injection of water and oxygen after the front 23 is established and moving can also employ varying volumes and amounts, depending upon the particular desires of the operator. Again, these parameters are not critical to the operation of the process and are readily determinable by those skilled in the art.

EXAMPLE

Two wells are completed in an oil-bearing formation substantially as shown in the drawing, reservoir 3 having a permeability of 100 millidarcies and having therein residual crude oil left after the reservoir has been subjected to a standard secondary recovery water flood.

Salt water recovered from an underground source is injected into annulus 10 at a rate of 5 gallons per minute, while an oxygen stream containing 95 volume percent oxygen and essentially no nitrogen is injected into tubing 22 at the rate of 30 cubic feet per minute. The oxygen and salt water streams are injected at ambient temperature and at pressures sufficient to force the water and oxygen out of wellbore 6 and into formation 3. A fire is ignited in formation 3 adjacent to zone 12 and then, with continued injection of water from annulus 10 and oxygen from zone 12, a displacement front 23 is set up and pushed toward wellbore 13. This results in an increased flow of crude oil from reservoir 3 into wellbore 13.

Reasonable variations and modifications are possible within the scope of this disclosure without departing from the spirit and scope of this invention.

I claim:

1. A method for conducting an in situ combustion process in a hydrocarbon-bearing subsurface geologic formation comprising providing at least one wellbore having a tubing string in the interior thereof extending for a portion of the length thereof to the vicinity of said formation and an annulus between the exterior of said tubing and interior of said wellbore, the portion of said wellbore below the end of said tubing being physically separated from said annulus, injecting water into said annulus and from there into an upper portion of said formation, at essentially the same time as said water injection injecting essentially pure oxygen into said tubing and from there into a lower portion of the same said formation for in situ combustion of said oxygen and part of the hydrocarbon already present in said formation, whereby said water and oxygen are separately injected into said formation without prior mixing of same in said wellbore.

2. The method according to claim 1 wherein said essentially pure oxygen stream injected into said wellbore contains at least 90 volume percent elemental oxygen.

3. The method according to claim 2 where said oxygen stream contains essentially no nitrogen.

4. The method according to claim 1 wherein said water is salt water.

5. The method according to claim 1 wherein said water is fresh water.

6. The method according to claim 1 wherein said water is injected at a rate of at least 3 gallons per minute and said oxygen is injected at a rate of at least 20 cubic feet per minute.

* * * * *